US010932067B2

(12) United States Patent
Leenen

(10) Patent No.: US 10,932,067 B2
(45) Date of Patent: Feb. 23, 2021

(54) HEAD-WEARABLE HEARING DEVICE WITH IMPACT ENABLED REBOOT

(71) Applicant: GN HEARING A/S, Ballerup (DK)

(72) Inventor: Joseph Renier Gerardus Maria Leenen, Veldhoven (DK)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 16/702,451

(22) Filed: Dec. 3, 2019

(65) Prior Publication Data

US 2020/0186944 A1 Jun. 11, 2020

(30) Foreign Application Priority Data

Dec. 11, 2018 (EP) ..... 18211698

(51) Int. Cl.
*H04R 25/00* (2006.01)

(52) U.S. Cl.
CPC ..... *H04R 25/50* (2013.01); *H04R 25/305* (2013.01); *H04R 25/554* (2013.01); *H04R 25/602* (2013.01); *H04R 25/604* (2013.01); *H04R 2225/33* (2013.01)

(58) Field of Classification Search
None
See application file for complete search history.

(56) References Cited

U.S. PATENT DOCUMENTS 8,175,305 B2 5/2012 Chew et al.
8,885,864 B2 11/2014 Andersen
2005/0141741 A1* 6/2005 Van Oerle ..... H04R 25/505 381/323
2009/0257608 A1* 10/2009 Chew ..... H04R 25/305 381/312
2011/0312385 A1 12/2011 Lee
2012/0300965 A1 11/2012 Howard
2016/0308386 A1* 10/2016 Tang ..... H02J 7/027
2017/0371616 A1 12/2017 Jie et al.
2018/0077502 A1 3/2018 Pedersen et al.
2018/0220241 A1* 8/2018 Naumann ..... H04R 25/554
2020/0015022 A1* 1/2020 Chang ..... H04R 25/554

FOREIGN PATENT DOCUMENTS

DE 10145994 A1 4/2003

OTHER PUBLICATIONS

Extended European Search Report dated May 20, 2019 for corresponding European Application No. 18211698.8.

* cited by examiner

*Primary Examiner* — Paul W Huber
(74) *Attorney, Agent, or Firm* — Vista IP Law Group, LLP

(57) ABSTRACT

A head-wearable hearing device includes: a housing; a microphone arrangement configured to generate a microphone signal in response to incoming sound; a digital signal processor configured to generate a processed output signal based on the microphone signal in accordance with one or more audio processing algorithms; an impact sensor configured to generate an impact pulse or impact signal in response to mechanical impact of the housing; and a reset circuit configured to apply a reset signal to the digital signal processor to place the digital signal processor in a predetermined logic state; wherein the reset circuit is configured to generate the reset signal in response to the impact pulse or the impact signal generated by the impact sensor.

26 Claims, 6 Drawing Sheets

300

HEAD-WEARABLE HEARING DEVICE WITH IMPACT ENABLED REBOOT

RELATED APPLICATION DATA

This application claims priority to, and the benefit of, European Patent Application No. 18211698.8 filed on Dec. 11, 2018. The entire disclosure of the above application is expressly incorporated by reference herein.

FIELD

The present disclosure relates to a head-wearable hearing device comprising an impact sensor responsive to an impact on the device housing to generate a corresponding impact signal or impact pulse. A reset circuit is configured to generate and apply a reset signal to a digital processor of the head-wearable hearing device in response to the impact pulse to place the digital processor in a predetermined logic state.

BACKGROUND

Different kinds of head-wearable hearing devices such as hearing aids are known in the art and may be used for amplification of audio signals, such as environmental sounds, warning signals, speech and music, for hearing impaired individuals or patients that have with different degrees of hearing loss. Hearing aid devices may have different designs based on a specific need and/or on the different aspects necessary for a particular device. One important aspect of the design of a hearing aid is the type of battery technology that is utilized, i.e. either a traditional non-rechargeable battery, such as a 1.2 V Zinc-air button cell, or a rechargeable battery such as a Li-Ion cell. In the latter case, the hearing aid may lack a user-operable battery door or chamber and the rechargeable battery arranged in a hermetically sealed manner within housing of the hearing aid.

Rechargeable batteries are gaining popularity in head-wearable hearing devices because these possess certain attractive properties compared to their traditional counterparts with disposable, non-rechargeable, batteries. Noticeable advantages are smaller size and increased mechanical durability because miniature and often fragile moving parts associated a movable battery door may be eliminated. Another advantage associated with the use of a rechargeable battery is improved moisture resistance due to the lack of miniature cracks and leaks into the housing created by the moveable battery door.

Another clear trend in contemporary hearing aid design is the utilization of wireless links for user control of the hearing aid functionality wherein the wireless control may be performed through a dedicated remote control or by using a mobile application, e.g. phone-installed app. Head-wearable hearing devices that have both of these design options, i.e. a rechargeable battery and wireless control options, are increasingly gaining popularity in the marketplace due to their ease of use, small size and associated user/patient comfort, as well as improved reliability. A head-wearable hearing device which comprises an inductively rechargeable battery and being completely controlled by wireless control means may be made so small that control buttons or switches are impractical to operate for a user. The absence of controls on the surface of the hearing aid housing therefore also contributes to improved reliability and reduced size.

However, there exist certain challenges in the construction of head-wearable hearing devices without control buttons or switches and without user operable battery doors. One challenge is to reset/reboot a digital processor, such as a microprocessor and/or DSP, of the head-wearable hearing device if the digital processor enters a dead-end failure mode, i.e. a non-operational mode where the DSP "hangs". In this situation the digital processor has stopped operating correctly, for example halted program execution and typically rendered unable to respond to wireless control signals, button control signals etc.

This type of dead-end failure modes may be a minor problem in traditional head-wearable hearing devices using disposable, and therefore user replaceable, batteries. Under the latter circumstances it is fairly straightforward for the user to reboot or restart the digital processor by simply opening and closing the battery door—possibly involving waiting a few seconds between the opening and closing of the battery door to carry-out a power-on-reset of the digital processor and thereby force the digital processor back to a functional state. However, this reboot option is typically not available to the user of a rechargeable battery powered head-wearable hearing device. This is because the rechargeable battery typically is arranged inside the sealed device housing and therefore inaccessible to the user of the head-wearable hearing device.

Therefore, there is a need in the art of a simple and convenient reboot mechanism for head-wearable hearing devices that employ rechargeable batteries, in particular where the head-wearable hearing device in question also lacks traditional user actuable control buttons or switches for operating the head-wearable hearing device.

SUMMARY

A first aspect relates to a head-wearable hearing device comprising a housing and a microphone arrangement configured to generate a microphone signal in response to incoming sound. An impact sensor of the head-wearable hearing device is responsive to an impact on the housing to generate a corresponding impact signal or impact pulse. A digital processor, such as a digital signal processor (DSP), is configured to process the microphone signal in accordance with one or more audio sound processing algorithms to generate a processed output signal. The head-wearable hearing device additionally comprises a reset circuit configured to generate, and apply, a reset signal to the digital processor to place the digital processor in a predetermined logic state, wherein said reset circuit is configured to generate the reset signal in response to the impact pulse. The predetermined logic state is preferably a boot state or initial state of the digital processor. The skilled person will understand that the digital signal processor may comprise a software programmable microprocessor controlled by a set of executable program instructions held in a memory device or memory area of the head-wearable hearing device for example integrated on-chip with the digital signal processor.

The head-wearable hearing device may comprise a hearing instrument or hearing aid such as a BTE, RIE, ITE, ITC, RIC or CIC etc. The hearing aid may comprise one or several microphone(s) for picking-up incoming sound from the external environment of the device and generate the microphone signal in response. The head-wearable hearing device may alternatively be a headset, headphone, earphone, ear defender, or earmuff, etc., such as an Ear-Hook, In-Ear, On-Ear, Over-the-Ear, Behind-the-Neck, Helmet or Headgear, e.g. wireless headsets, wireless headphones, or the external part of a cochlear implant, etc.

The audio processing algorithm(s) and/or various control tasks of the head-wearable hearing device may be executed or implemented by dedicated digital hardware of the digital processor or by one or more computer programs, program routines and threads of execution running on the software programmable digital processor or processors or running on a software programmable microprocessor. Each of the computer programs, routines and threads of execution may comprise a plurality of executable program instructions that are stored in non-volatile memory of the head-wearable hearing device. Alternatively, the audio processing algorithms may be implemented by a combination of dedicated digital hardware circuitry and computer programs, routines and threads of execution running on the software programmable digital signal processor or microprocessor. The software programmable digital processor, microprocessor and/or the dedicated digital hardware circuitry may be integrated on an Application Specific Integrated Circuit (ASIC) or implemented on a FPGA device.

One embodiment of the head-wearable hearing device comprises at least one of the following:

- a DC-DC power converter, such as a switched-capacitor (SC) DC-DC converter, configured to generate a power supply voltage of the digital signal processor by conversion of a battery voltage;
- a battery voltage input for receipt of a battery voltage to provide a power supply voltage of the digital signal processor. The DC-DC power converter may comprise a step-down converter, for example converting a relatively high battery voltage supplied by one or more rechargeable battery cell(s) with a factor 2:1 or 3:1, or any other suitable ratio, to match the high battery voltage to a preferred DC supply voltage of the digital processor. Other embodiments of the head-wearable hearing device may be supplied with battery voltage by a traditional 1.2 V disposable, and non-rechargeable, battery cell.

The head-wearable hearing device preferably comprises a miniature loudspeaker or receiver, i.e. a so-called moving armature receiver, comprising a signal input connected to the processed output signal to generate a corresponding processed sound signal for transmission to the user's ear canal. The miniature loudspeaker or receiver may be arranged inside the housing of the head-wearable hearing device and the processed sound signal transmitted to the user's ear canal via a sound tube and/or an earplug. Alternatively, the miniature loudspeaker or receiver may be arranged in the earplug and the processed output signal transmitted to the signal input by one or more electrical wires or conductors.

According to one embodiment of the head-wearable hearing device the impact sensor is embodied as the miniature loudspeaker or receiver such that a diaphragm and an electrodynamic motor drive of the miniature loudspeaker function as the impact sensor. This embodiment provides a compact and low-cost impact sensor because of the double functionality of the miniature loudspeaker. The impact signal or pulse is preferably derived from an input terminal of the miniature loudspeaker where this input terminal also serves an audio signal input of the miniature loudspeaker as discussed in additional detail below with reference to the appended drawings.

In some embodiments of the head-wearable hearing device the impact pulse is coupled to a reset input of the reset circuit to activate or assert the reset signal. In alternative embodiments of the head-wearable hearing device the impact pulse serves to temporarily disconnect the power supply voltage of the digital signal processor which in turn activates the reset circuit in an indirect manner as discussed in additional detail below with reference to the appended drawings. According to one such embodiment, the head-wearable hearing device comprises a controllable supply switch circuit configured to temporarily disconnect the power supply voltage of the digital signal processor in response to the impact pulse. The reset circuit is configured to monitor the power supply voltage of the digital signal processor and configured to assert the reset signal in response to interruption of the power supply voltage. The controllable supply switch circuit may be electrically connected between at least one of:

- the battery voltage input of the hearing device and a supply voltage input of the DC-DC power converter, and
- an output voltage of the DC-DC power converter and a supply voltage input of the digital signal processor.

According to another embodiment of the head-wearable hearing device the controllable supply switch circuit is operatively connected between a battery voltage input of the device and a DC reference potential, such as ground, to temporarily short-circuit the battery voltage input. This short-circuit action temporarily short-circuits the battery cell and removes the supply voltage input of the DC-DC power converter and/or power supply voltage of the digital signal processor. Some battery types may tolerate this type of temporary short-circuit without being damaged. The controllable supply switch circuit may be configured to disconnect the power supply voltage of the digital signal processor for a time period between 10 ms and 2 seconds.

In one embodiment, controllable supply switch circuit is configured to temporarily shut-down or deactivate the DC-DC power converter e.g. by interrupt a clock signal of the DC-DC power converter. The interruption of the clock signal may halt the switching action of the DC-DC power converter and hence transfer of energy from the supply voltage input to the output voltage of the DC-DC power converter.

The controllable supply switch circuit may comprise at least one controllable switch, such as a semiconductor switch or microelectromechanicalsystem (MEMS) switch. The at least one controllable switch may comprise:

- a switch input node, a switch output node and control terminal; said control terminal configured to switch the controllable supply switch circuit between:
- a conducting state/on-state in which a switch input node and a switch output node are electrically connected, e.g. with a resistance less than 100Ω; and
- a non-conducting state/off-state in which the switch input node and the switch output node are electrically disconnected, e.g. with a resistance larger than 1 GΩ.

The head-wearable hearing may comprise a threshold circuit coupled to the impact pulse where the threshold circuit is configured to eliminate or suppress impact pulses or signals below a predetermined threshold level or amplitude such as below 1.0 V, 2.0 V or 5.0 V. The predetermined threshold serves to distinguish between impact pulses generated by normal use of the head-wearable hearing device and impact pulses of sufficiently high level or amplitude to represent an impact event and should therefore trigger the reset circuit as discussed in additional detail below with reference to the appended drawings. The threshold circuit may comprise a comparator which comprises a first input connected to the impact pulse and a second input connected to a reference voltage generator setting the predetermined threshold voltage. A comparator output is connected to a control input of the controllable supply switch circuit wherein a logic state of said comparator output indicates a voltage or current difference between the first and second inputs.

The head-wearable hearing device may comprise a lowpass filter configured to lowpass filtering the impact pulse wherein the lowpass filter may have a cut-off frequency below 1 kHz.

The head-wearable hearing device may comprise one or more rechargeable battery cell(s) arranged inside the housing and configured for supplying the battery voltage. The housing of the head-wearable hearing device may be without a user actuable battery chamber holding the rechargeable battery cell which leads to several advantages in terms of mechanical construction and reliability of the head-wearable hearing device as mentioned above and discussed in additional detail below with reference to the appended drawings. The housing of the head-wearable hearing device may lack user actuable controls such as control switches, knobs, push-buttons etc. for the reasons mentioned above.

A second aspect relates to a method of rebooting a digital processor of a head-wearable hearing device according to any of the preceding claims, said method comprising:

a) detecting that the head-wearable hearing device resides in a non-operational state without sound reproduction, b) removing the head-wearable hearing device from the ear, c) striking the housing of the head-wearable hearing device against a hard surface to actuate the impact sensor and generate the impact pulse.

BRIEF DESCRIPTION OF THE DRAWINGS

Exemplary embodiments will be described in more detail in connection with the appended drawings, in which.

DESCRIPTION OF PREFERRED EMBODIMENTS

Figure 1:
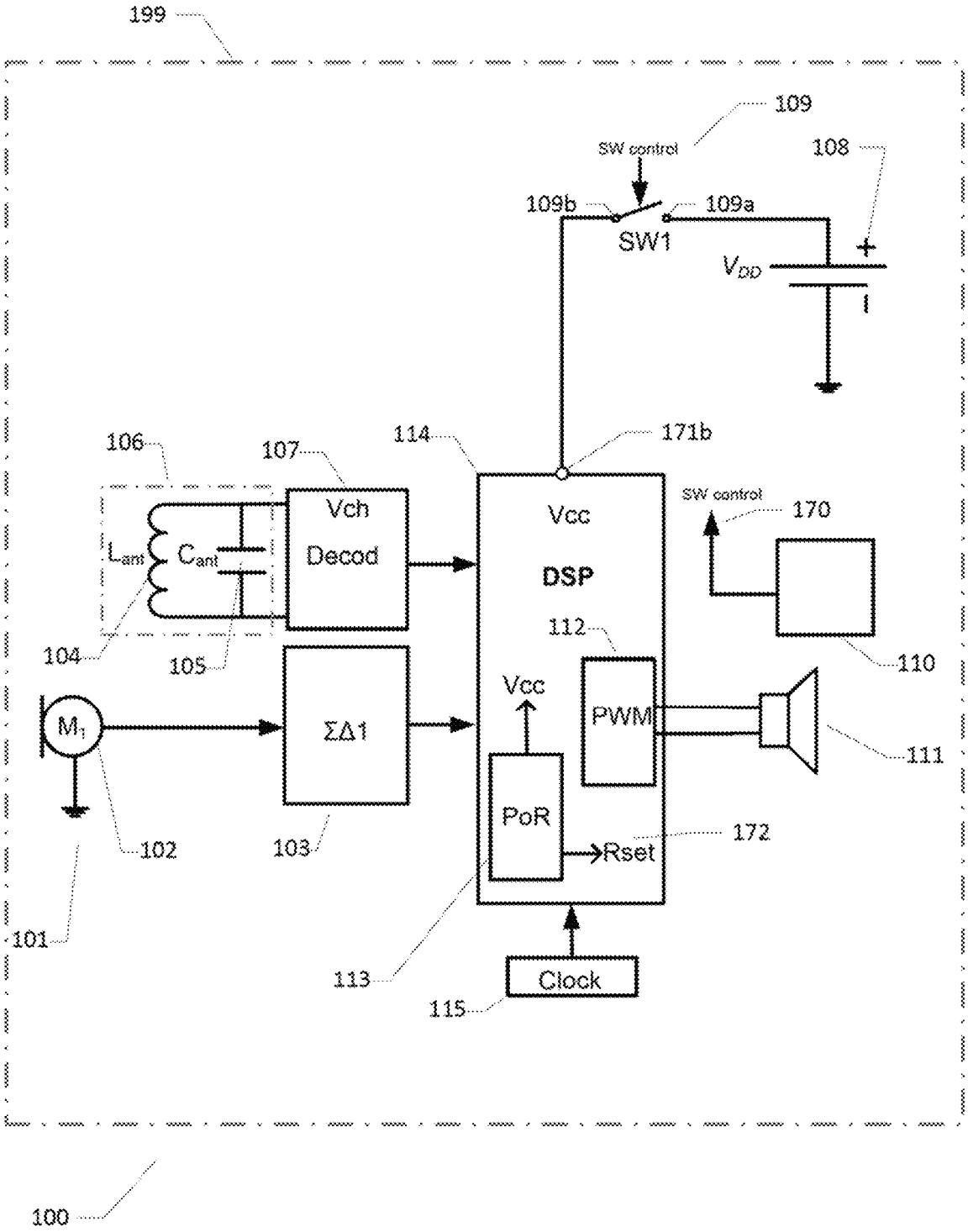
FIG. 1 shows a simplified schematic block diagram of a head-wearable hearing device comprising a separate impact sensor according to a first embodiment.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

In the following description various exemplary embodiments of the present head-wearable hearing device are described with reference to the appended drawings. The skilled person will understand that the accompanying drawings are schematic and simplified for clarity. Similar reference numerals (e.g. 101, 201, 301) refer to similar elements or components throughout the description of the application. Therefore, similar elements will not necessarily be described in detail with respect to each figure. It is understood that the elements have similar functioning.

FIG. 1 is a schematic representation or a block diagram of a first embodiment of the present head-wearable hearing device 100, wherein a stand-alone impact sensor 110 transmits an impact signal or an impact pulse 170 to a controllable power supply switch circuit 109 to temporarily remove power from a digital signal processor (DSP) 114 of the head-wearable hearing device 100. The impact sensor 110 is responsive to an impact on the housing 199 in order to generate the impact signal or pulse 170. The impact sensor 110 may comprise an accelerometer or velocity sensor. In this embodiment the impact sensor 110 is shown as a stand-alone or a separate component or a device, however, in alternative embodiments, the impact sensor 110 could be an integral part of the DSP circuit 114. In some other embodiments, the impact sensor function 110 may be performed by the already present miniature loudspeaker or receiver 111, which will be described further in detail. The embodiments described herein describe a head-wearable hearing device 100 that comprises multiple components enclosed in a housing 199.

The head-wearable hearing device 100 comprises of a microphone arrangement 102, which may comprise one or several microphones, generating a microphone audio signal in response to incoming sound 101. The microphone audio signal or microphone signal is amplified/buffered and digitized in an input channel comprising an optional microphone preamplifier (not shown). The amplified or buffered microphone signal is being processed by an Analog-to-Digital (ADC) converter 103 which preferably comprises an oversampled Sigma-Delta modulator 103. The output signal of the ADC 103 is a digital microphone signal that may comprise a single-bit delta-sigma modulated signal or a multi-bit, e.g. PCM, digital microphone signal.

The digital microphone signal is being supplied to the DSP 114 through an appropriate input port or channel (not shown) of the DSP 114. The DSP 114 may be a part or sub-circuit of a general microprocessor (not shown), but the skilled person will recognize that DSP 114 may at least perform necessary calculations in connection with digital signal processing algorithms applied to the digital microphone signal. Therefore, for simplicity reasons the notion DSP is used hereafter. The digital signal processing algorithms can include, but are not limited to, feedback management or feedback cancellation, wide dynamic range compression, directional processing or beamforming of multiple microphone signals, frequency lowering, multi-channel or single-channel noise reduction or any other suitable algorithm embedded in the head-wearable hearing device 100. The digital signal processing algorithms are running on, or executed by, the DSP 114. The digital signal processing algorithms may be selected and/or customized depending on the hearing loss data of an individual user and may be performing audio signal processing in real-time, preferably with a minimal time delay. The digital signal processing algorithms are applied to the digital microphone signal to produce a processed output signal.

The head-wearable hearing device 100 may further comprise of a LC resonant circuit 106, which consists of an inductor 104 and a capacitor 105 connected in parallel. LC resonant circuit 106 may serve as a near-field magnetic inductive antenna to receive and/or transmit wireless digital data or signals between an external device, such as another hearing instrument or a portable terminal, and the head-wearable hearing device 100. The LC resonant circuit 106 may be coupled to a channel decoder 107, wherein the channel decoder 107 may act as a wireless transceiver.

The DSP 114 may be powered by a battery cell 108 which may comprise a rechargeable or a non-rechargeable battery cell 108. The DSP 114 may be further linked to a clock generator 115. The clock generator 115 generates a clock signal which is coupled to a clock input of the DSP 114. A clock frequency of the clock generator 115 may lie above 2 MHz, for example between 5 and 40 MHz. The clock generator 115 can generate a clock signal with different clock frequencies depending on a specific requirement of a particular head-wearable hearing device 100. The DSP 114 generates the previously discussed processed output signal which is applied to an input of a class D output amplifier 112 which may comprise a Pulse-Width Modulator (PWM) or a Pulse-Density Modulator (PDM). Both the PWM and PDM may be configured to modulate the processed output signal to the miniature loudspeaker 111 with a predetermined modulation frequency for example between 250 kHz and 2 MHz. A pair of input terminals of the miniature loudspeaker 111 is connected to an output of the class D output amplifier 112 and thereby produces a processed sound signal for application to the user's ear canal representative of the processed output signal.

Generally, DSP 114 comprises multiple sub-circuits which perform the processing of incoming microphone and/or wireless data signals and/or processed sound signals. DSP 114 further comprises a reset circuit 113 that may be a Power-on-Reset (PoR) circuit. The head-wearable hearing device 100 may comprise a hearing instrument or aid comprising various types of hearing aid housing styles such as Behind-the-Ear (BTE), In-the-Canal (ITC), Completely-in-Canal (CIC), Invisible in the Canal (IIC), Receiver in Canal (RIC) etc.

Further, the operation of the head-wearable hearing device 100 disclosed in FIG. 1 will be described. The DSP 114 is powered by a power supply voltage, which preferably is supplied by a rechargeable battery cell or optionally a non-rechargeable battery cell 108 such as a standard Zinc-Air cell or a Carbon, Alkaline, Lithium or other non-rechargeable battery types. The power supply voltage $V_{DD}$ is connected to a supply voltage input 171*b* of the DSP 114 via a controllable supply switch circuit 109. In the current embodiment, the controllable supply switch circuit 109 comprises a semiconductor switch arrangement, which in turn, may comprise of a Metal Oxide Semiconductor Field Effect Transistor (MOSFET) type switch. In further embodiments, other types of switches can be used based on a specific need. These can include, but are not limited to, Field Effect Transistor (FET), bipolar transistors, Micro-Electro Mechanical System (MEMS) switches, Nano-Electro Mechanical System (NEMS) switches and other controllable switch circuit types. In further embodiments the controllable supply switch circuit 109 may be operatively connected, e.g. via a switched-capacitor DC-DC power converter (as described in alternative embodiments below), between the supply voltage input 171*b* of the DSP 114 and the power supply voltage $V_{DD}$ supplied by the battery 108.

A state of the controllable supply switch circuit 109 is controlled by the previously discussed impact signal or pulse 170, SW control, produced by the impact sensor 110 in response to an impact force or acceleration of the housing 199. When the impact signal or pulse 170 has a small level, the housing 199 is either not accelerated or is only subjected to small accelerations for example caused by the users walking, jumping or running. The controllable supply switch circuit 109 resides in its on-state such that the power supply voltage $V_{DD}$ is electrically coupled to the supply voltage input 171*b* of the DSP 114 via, a preferably small, on-resistance of the controllable supply switch circuit 109. Hence, in the on-state of the controllable supply switch circuit 109, the power supply voltage of the DSP 114 at the supply voltage input 171*b* largely corresponds to the battery voltage $V_{DD}$. When the impact pulse 170 is present, the controllable supply switch 109 is switched to its off-state via the impact pulse 170 applied to the controllable supply switch circuit 109 such that the power supply voltage $V_{DD}$ at the supply voltage input 171*b* is interrupted. The controllable supply switch circuit 109 is configured to only temporarily disconnect a power voltage supply of the digital signal processor 114 in response to the impact pulse 170. The reset circuit 113 may be configured to monitor the power supply voltage at the supply voltage input 171*b* of the DSP 114 and activate or assert the reset signal in response to interruption of the supply voltage at the supply voltage input 171*b*. In response to the interruption of the supply voltage at the supply voltage input 171*b*, the reset circuit 113 activates or asserts the reset signal 172. Apart from temporarily removing the battery voltage, a second way of resetting the DSP 114 is to use the impact pulse or signal to directly generate a suitable reset signal at a reset input terminal of the DSP 114 and/or microcontroller(s) to reset the circuits as discussed in additional detail below with reference to FIG. 4. In the latter embodiment, the impact pulse works in a way similar to an externally accessible reset button if a reset button had been available.

The skilled person will appreciate that the DSP 114 of the head-wearable hearing device 100 may enter an error state, often denoted dead-end failure mode or hanging mode, where the DSP ceases to respond to inputs from any of the peripheral devices and/or circuits, or any of the loaded application programs or signal processing algorithms. In other words, the DSP "hangs". The present embodiment solves this problem by carrying out the above-described interruption of the power supply voltage to the supply voltage input 171*b* of the DSP 114 which in response activates the reset circuit 113 so as to generate the reset signal 172. The DSP 114 responds to the reset signal 172 by re-initializing hardware components of the DSP 114 such as memory registers etc. and re-loading the processing algorithms of the head-wearable hearing device 100 including, possibly, reloading an operating system kernel. In other words, the DSP 114 is rebooted. The reset circuit 113 may be configured activate or assert the reset signal 172 independently of any execution of the set of executable program instructions, e.g. performing signal processing algorithms and/or peripheral device handling, on the DSP 114 by creating a "hardware" generated reset signal 172 which is applied to the reset pin or terminal of the DSP when the latter "hangs", i.e. resides in an non-operational logic state. Consequently, the user may reset the DSP 114 to remedy a hanging state of the latter by banging or knocking the housing 199 of the head-wearable hearing device 100, e.g. banging on a hard surface such as a table, since this action generates the previously discussed impact signal or impact pulse 170, which has a markedly higher level or amplitude impact signals generated by normal use of the device 100. Upon the impact with the table surface, the housing 100 will experience a sudden change of speed which is sensed by the impact sensor 110 and leads to the previously discussed impact signal or pulse 170 in accordance with the instantaneous acceleration. This impact pulse activates the reset circuit 113 (Power-on-Reset (PoR) circuit) and may temporarily shut down operations of the DSP 114.

Since the impact pulse generated by the impact sensor 110 will typically be sufficiently short in time, e.g. 2-20 ms, due to the duration of the impact, the controllable supply switch circuit 109 may be configured to automatically return to its closed state and thereby restore the power supply voltage $V_{DD}$ to the DSP 114 after a pre-set period, e.g. 50-100 ms. The reset circuit 113 detects the restoration of the power supply voltage on the supply input 171*b* and in response deactivates or de-asserts the reset signal 172. This forces the DSP 114 into a predetermined logic state, e.g. a predetermined initial state or power-on state. Setting out from this state the DSP 114 initiates a power-on sequence of instructions which may comprise loading a kernel of the operating system (not shown) and reloading of the program variables and parameters. The power-on sequence may also comprise loading of the processing and the application programs, for example feedback management, wide dynamic range compression, directionality, frequency lowering, noise reduction or any other suitable algorithm into program memory and data memory of the DSP 114. Put in other words, the head-wearable hearing device 100 will be rebooted and returned to a fully functional/operational state. Thus, a simple and convenient user-operable rebooting mechanism is provided to reboot the head-wearable hearing device 100 in case of dead-end failure mode or state of non-response. Thus, the user will have an ability to return the head-wearable hearing device 100 to its normal operational state in a convenient manner without the need for any special tools.

The skilled person will appreciate that this user-operable rebooting mechanism is particularly helpful in embodiments of the head-wearable hearing device 100 where the housing 199 lacks an externally accessible or actuable battery door or chamber holding the rechargeable battery cell 108. In such embodiments, the DSP 114 cannot be reset by temporarily disconnecting the battery voltage, and hence the power supply voltage $V_{DD}$ of the DSP 114, e.g. by opening and closing the battery chamber. The above-described user-operable rebooting mechanism is likewise advantageous in other embodiments of the head-wearable hearing device 100 where the housing 199 has neither an externally accessible battery chamber nor any user-actuable controls such as control switches, knobs, push-buttons etc.

The controllable supply switch circuit 109 may comprise at least one controllable switch SW1 having a switch input node 109*a*, a switch output node 109*b* and control terminal (shown as SW control, without denotation), to which the impact signal or pulse is applied either directly, or indirectly via a threshold circuit, and/or a low-pass filter as discussed in detail below. The control terminal may be configured to switch the controllable supply switch circuit 109 between first and second operational states, i.e. between operational and non-operational state. The first state is a conducting state/on-state in which a switch input node 109*a* and a switch output node 109*b* are electrically connected, e.g. with a resistance less than 100Ω. The second one is a non-conducting state/off-state in which the switch input node 109*a* and the switch output node 109*a* are electrically disconnected, e.g. with a resistance larger than 1 GΩ.

Figure 2:
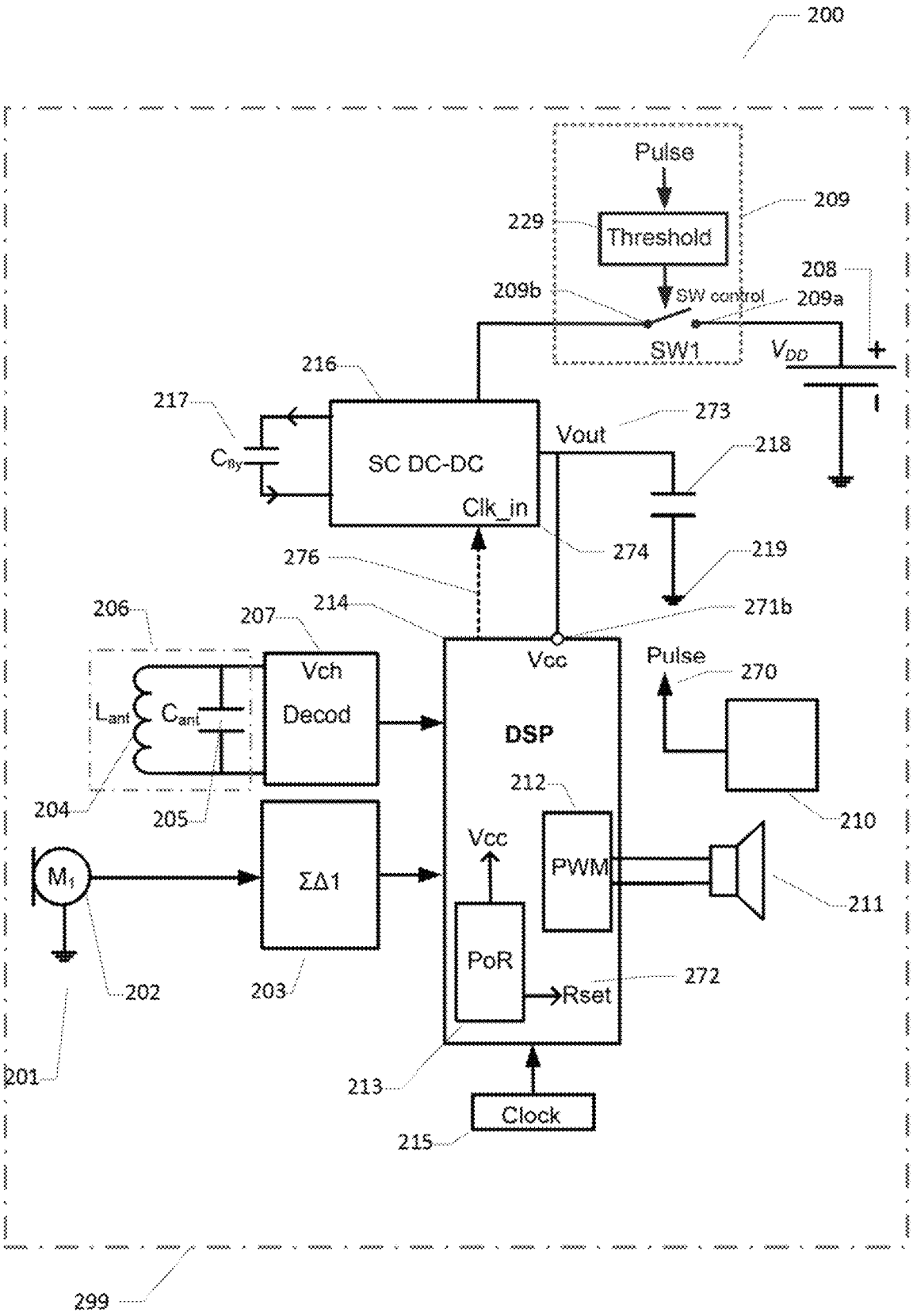
FIG. 2 shows a simplified schematic block diagram of a head-wearable hearing device according comprising a DC-DC converter and a threshold circuit according to a second embodiment.

FIG. 2 is a schematic representation or a block diagram of a second embodiment of the head-wearable hearing device 200, wherein a stand-alone impact sensor 210 transmits an impact signal or impact pulse 270 to a controllable supply switch circuit 209 in order to effectively reset a Digital Signal Processor (DSP) 214 of the head-wearable hearing device 200. The head-wearable hearing device 200 comprises a switched-capacitor DC-DC power converter 216, which supplies power to a power supply input 271*b* of the DSP 214 instead of having a connection to the battery voltage discussed in connection with the first embodiment of the device 100. The switched-capacitor DC-DC power converter 216 is connected to a power supply voltage $V_{DD}$ and the DSP 214. The switched-capacitor DC-DC power converter 216 may comprise one or several flying capacitor(s) 217. The switched-capacitor DC-DC power converter may be coupled directly or indirectly through the DSP 214, to a master clock generator 215. The clock generator 215 generates a clock signal to the DSP 214 which in turn may derive a clock signal 276 to the clock input 274 of the switched-capacitor DC-DC power converter 216. The clock signal 276 may be used to synchronize the operation of the DSP 214 and the switched-capacitor DC-DC circuit 216. A clock frequency of the clock generator 215 may lie above 2 MHz, for example between 5 and 40 MHz. The clock generator 215 can generate a clock signal with different clock frequencies depending on a specific requirement of a particular head-wearable hearing device 200. An output of the switched-capacitor DC-DC power converter 216 may be connected to a smoothing capacitor 218 connected to ground 219. The smoothing capacitor 218 may be configured for attenuating ripple voltage and other noise coming out from the switched-capacitor DC-DC power converter 216.

The head-wearable hearing device 200 comprises a controllable supply switch circuit 209 that is operatively connected, i.e. via the switched-capacitor DC-DC power converter 216, between the supply voltage input 271*b* of the DSP 214 and the battery voltage $V_{DD}$. The controllable supply switch circuit 209 generally operates like the controllable supply switch circuit 109 discussed in detail above in connection with the first embodiment, but differs from the latter by the inclusion of a threshold circuit 229. The function of the threshold circuit 229 is to eliminate or attenuate small levels of the impact signal, wherein the small levels merely reflect normal user handling of the head-wearable hearing device 200, for instance, when the user is walking or running. By inclusion of a threshold circuit 229, the unwanted impact signals or pulses 270, i.e. signals below a certain threshold and generated by the impact sensor 210, will be eliminated or attenuated. Thus, the threshold circuit 229 will prevent accidental or unwanted assertion of the reset signal 272 and its associated re-boot of the DSP 214.

The threshold circuit 229 may comprise a comparator with a first input connected to a predetermined threshold value such as 1.0 V, 2.0 V or 5.0 V and a second input connected to the acceleration signal or pulse 270. A comparator output, Sw control, is connected to a control input of the controllable supply switch circuit 209. The logic state of the comparator output is configured to indicate a voltage or current difference between the first and second inputs. The skilled person will understand that the exact value of the predetermined threshold value must be adapted to the sensitivity of the impact sensor 210. Hence, impact signals below the predetermined threshold value are ignored because the comparator output remains static in the logic state which places the controllable supply switch circuit 209 in its conducting state. On the other hand, when the impact signal exceeds the predetermined threshold value the comparator output switches logic state such that the controllable supply switch circuit 209 is switched to its non-conducting state and supply voltage $V_{out}$ to the DSP 214 interrupted.

The skilled person will understand that an off-resistance of the switch is large, e.g. larger than 1 GΩ or even larger than 10 GΩ, such that the power supply 208 to the switched-capacitor DC-DC power converter 216 is effectively interrupted. This leads to a corresponding discharge, with a certain time constant, of the regulated output voltage $V_{out}$ of the switched-capacitor DC-DC power converter 216 and eventually interruption of the power supply voltage $V_{cc}$ to the supply voltage input 271*b* of the DSP 214. The controllable supply switch 209 may be configured to only temporarily disconnect the power supply voltage $V_{DD}$ to the switched capacitor DC-DC power converter 216 in response to the impact signal or pulse 270. Thus, the controllable supply switch circuit 209 will temporarily switch between the first and the second operational state, i.e. between conducting and non-conducting states.

In this embodiment, the reset circuit 213 may be connected to the power supply voltage at the supply voltage input 271*b* of the DSP 214 and monitor the power supply voltage. The reset circuit 213 is configured to activate or assert the reset signal 272 in response to a detected interruption of the power supply voltage in the same manner as discussed in detail above in connection with the first embodiment.

According to another embodiment of the device 200, the supply voltage $V_{out}$ to the DSP 214 is interrupted by temporarily interrupting or pausing the clock signal 276 applied to the clock input 274 of the switched-capacitor DC-DC power converter 216. The interruption of the clock signal 276 to the switched-capacitor DC-DC power converter 216 interrupts operations of the latter such that the regulated output voltage $V_{out}$ is discharged. The interruption of the clock signal 276 may be accomplished by electrically connecting the at least one controllable switch SW1 in series with the clock signal 276 instead of in series with the power supply voltage $V_{DD}$.

As discussed above, due to the functionality of the threshold circuit 229, the head-wearable hearing device 200 is only rebooted when the acceleration of the housing 299 reaches a sufficiently large value, e.g. when subjected to an impact. This can be achieved by e.g. by banging the housing 299 on a table or similar hard surface. In the current embodiment, and in the subsequent embodiments discussed below, a low-pass filter (not shown) may be utilized to perform low-pass filtering of the impact signal or pulse 270 before being inputted to the threshold circuit 229. The low-pass filter may have a cut-off frequency below 1 kHz and its operation is described in detail in subsequent sections.

Figure 3:
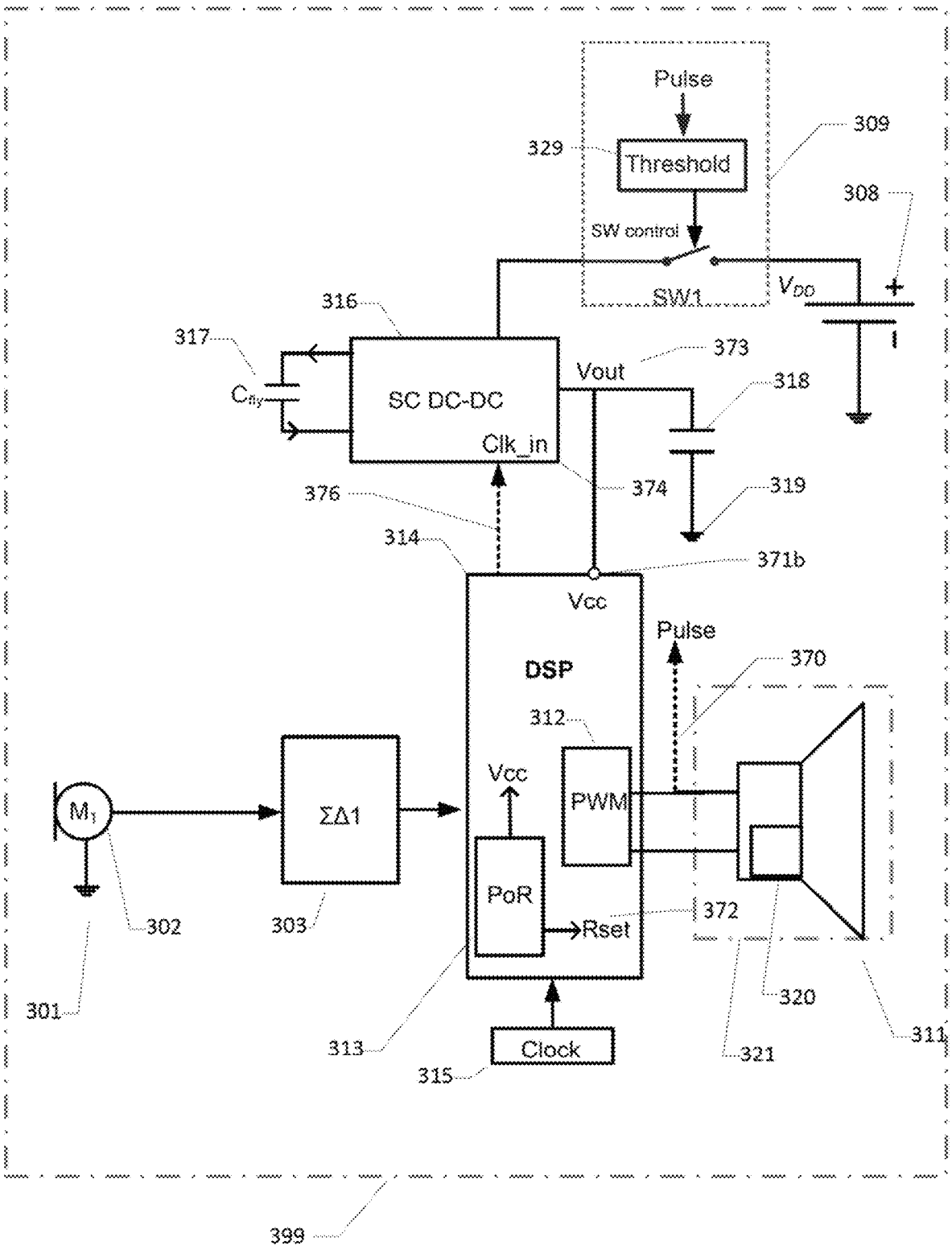
FIG. 3 shows a simplified schematic block diagram of a head-wearable hearing device comprising a moving armature receiver used as an impact sensor according to a third embodiment.

FIG. 3 is a schematic representation or a block diagram of a third embodiment of the head-wearable hearing device 300, wherein instead of a stand-alone impact sensor 320, the impact sensor 320 is an integral part of the miniature loudspeaker 311. Alternatively, the miniature loudspeaker 311 may itself act as an impact sensor 320 therefore omitting the need to have an impact sensor as a separate component or a separate device. The miniature loudspeaker 311 or the built-in acceleration sensor 320 transmits an impact signal or pulse 370 to the controllable supply switch circuit 309 in order to effectively reset a Digital Signal Processor (DSP) 314 of the head-wearable hearing device 300. Similarly, to the embodiment described in FIG. 2, this embodiment comprises a switched-capacitor DC-DC power converter 316, wherein the controllable supply switch circuit 309 may be operatively connected between the voltage supply 308 and the switched-capacitor DC-DC power converter 316. The power supply voltage $V_{DD}$ energizes the DSP 314 through its supply voltage input 371*b* coupled to an output voltage of the switched-capacitor DC-DC power converter 316. In a manner similar to the second embodiment, the impact pulse 370 is applied to a threshold circuit 329 and the output of the threshold circuit used to control the input to the controllable supply switch circuit 309 for filtering or attenuating small or insignificant levels of the impact signal or pulse 370.

The operation of the head-wearable hearing device 300 is similar to the one described above in connection with FIG. 2, but differs from the latter in a construction of the impact sensor 320. In the present embodiment, the impact sensor 320 may be integrated with the miniature loudspeaker 311, for example by placing the impact sensor 320, such as a MEMS acceleration sensor, inside a housing of the miniature loudspeaker 311. The impact sensor may therefore comprise one or several dedicated output signal terminals, e.g. on the housing of the loudspeaker, which are additional to the conventional loudspeaker signal terminals. Alternatively, the impact sensor 320 may be embodied as the miniature loudspeaker 311, such that movement or acceleration of a diaphragm (not shown) of the miniature loudspeaker 311 generates the impact signal or pulse 370. Hence, the miniature loudspeaker 311 operates in a "reverse mode", relative to sound reproduction, where the diaphragm and electrodynamic motor assembly of the miniature loudspeaker 311 functions as an impact sensor as discussed in additional detail in the following with reference to this embodiment.

In the first embodiment according to FIG. 3 where the impact sensor 320 is integrated with the miniature loudspeaker 311, the impact sensor 320 may function in a substantially similar manner to the impact sensors 120, 220 described in the previous embodiments. The impact sensor 320 may comprise a capacitive, piezo-electric, convective sensor types, such as a Micro-Electro-Mechanical System (MEMS) or Nano-Electro-Mechanical System (NEMS). Upon the response of the acceleration from the housing 399, the impact sensor 320 may generate an impact signal or pulse 370 and supply it to the controllable supply switch circuit 309 through the threshold circuit 329.

In the second embodiment according to FIG. 3, the need for a separate impact sensor 320 is eliminated and a movable diaphragm and an electrodynamic motor assembly coupled thereto of the miniature loudspeaker 311 functions as the impact sensor. Hence, the miniature loudspeaker 311 operates as a traditional loudspeaker for sound reproduction when the PWM and PDM modulated processed output signal is applied to the input terminals of the loudspeaker. However, the miniature loudspeaker 311 additionally operates in a "reverse mode", e.g. as an impact sensor 320 when the loudspeaker 311 and/or the housing 399 is accelerated, e.g. by an impact. The movement of the diaphragm caused by the acceleration, and the coupling between the electrodynamic motor assembly and the diaphragm, generates an impact pulse 370 representative of the acceleration at the input terminals of the miniature loudspeaker 311. For clarity reasons, in the embodiments where the miniature loudspeaker 311 operates in "reverse mode" to provide the impact signal or pulse 370, reference numeral 321 will be utilized instead of reference numeral 311. However, in embodiments wherein a separate (built-in) impact sensor 320 is utilized, the denotation 311 will be preserved. The skilled person will understand that the controllable supply switch circuit 309 may comprise a low-pass filter with a certain cut-off frequency, e.g. 100 Hz or 1 kHz, and this low-pass filter may be inserted before the threshold circuit 329 to suppress high-frequency components of the PWM or PDM processed output signal applied to the input terminals of the miniature loudspeaker/receiver 311 by the Class D output amplifier 312.

The low-pass filter may be helpful to prevent false triggering of the controllable supply switch circuit 309 by the presence of such high-frequency signal components, e.g. above 250 kHz, on the loudspeaker terminals and caused by the integration of the loudspeaker functionality and impact sensor functionality.

The miniature loudspeaker 311 or miniature loudspeaker 321 could be any type of loudspeaker known in the art. As a way of example and for describing the operational principles the inventors will use a moving armature loudspeaker as impact sensor and experimental results supporting this embodiment are described below with reference to FIG. 6. However, the skilled person will immediately recognize that other types of loudspeakers may be used, such as moving coil loudspeakers, also called a electrodynamic loudspeaker.

In certain alternative embodiments (not shown) the controllable supply switch circuit 309 may be connected between the power supply voltage $V_{DD}$ and a DC reference potential (not shown) such as ground GND. In these alternative embodiments, the impact sensor 310 may generate an impact signal or pulse 370 supplied to the controllable supply switch circuit 309 to switch the latter from its ordinarily non-conducting state to a conducting state. The conducting state leads to a temporarily short-circuiting of the power supply voltage $V_{DD}$ supplied by the rechargeable battery cell or cells 308 and therefore interrupts the power supply voltage to the supply voltage input 371*b* of the DSP 314 for reasons already discussed above. This action triggers the reset signal 372 generated by the reset circuit 313 as discussed before.

Figure 4:
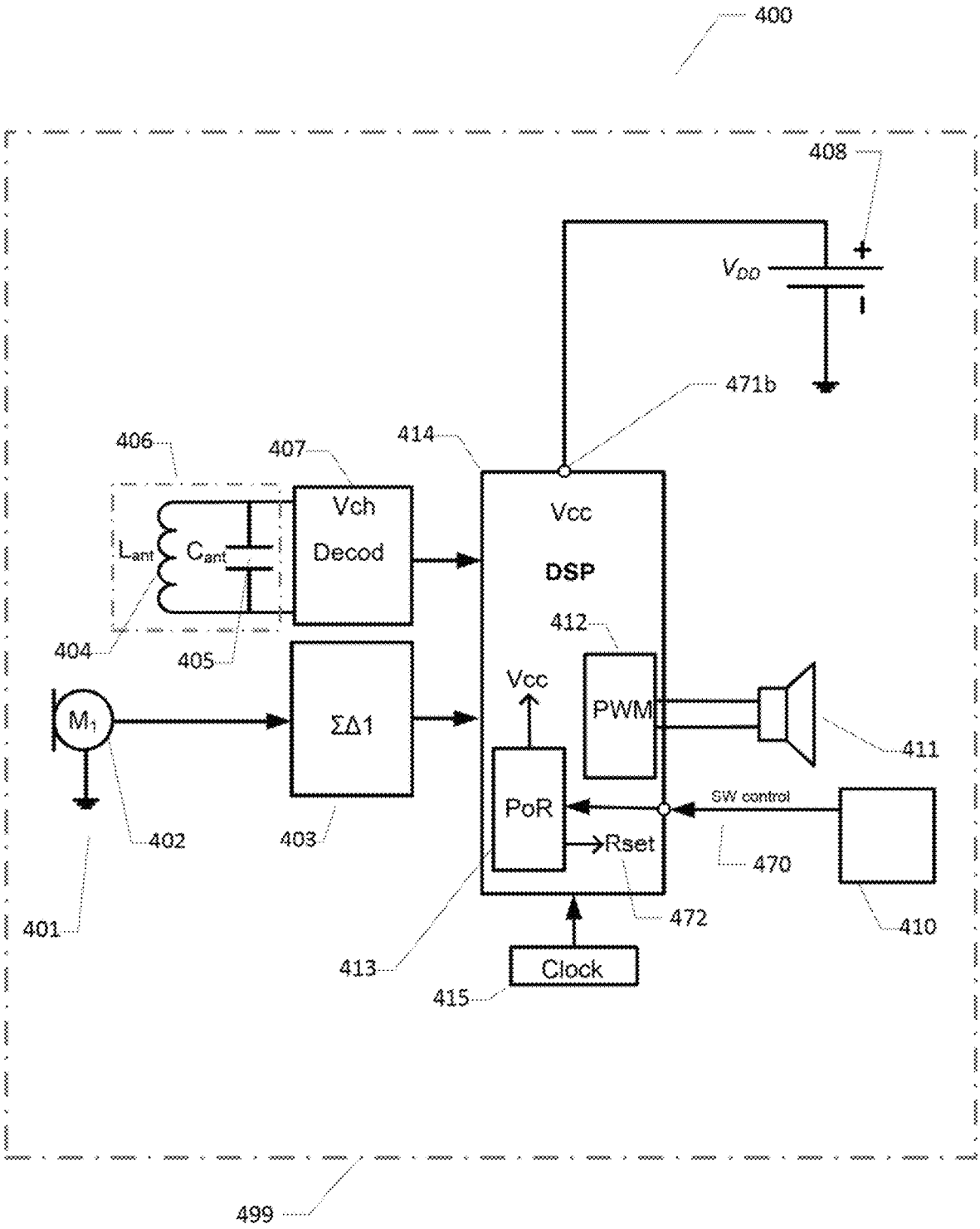
FIG. 4 shows a simplified schematic block diagram of a head-wearable hearing device according to a fourth embodiment.

FIG. 4 is a schematic representation or a block diagram of a fourth embodiment of the head-wearable hearing device 400 which is configured to effect reset or reboot of the DSP 414 without using the previously discussed controllable supply switch circuits 209, 309. In the present embodiment of the head-wearable hearing device 400, the acceleration sensor 410 applies the impact signal or pulse 470 directly to the reset circuit 413 which preferably is integrated on the integrated circuit holding the DSP 414. The impact signal or pulse 470 may be supplied through an input terminal on the DSP 414 for example a pad of an integrated CMOS circuit holding the DSP 414. The reset circuit 413 generates or assert a reset signal 472 in response. The reset circuit 413 may temporarily shut down the operation of the DSP 414, wherein the operation of the DSP 414, the reset circuit 413 and the re-initialization of hardware and/or processing algorithms is similar to the previously described embodiments.

The skilled person would immediately recognize that the reset circuit 413 may be embodied as on-chip hardware circuitry which functions independently of a processor core of the DSP 414 to ensure the reset circuit 413 remains responsive to the impact pulse when the core of DSP 414 is caught in the dead-end failure mode, i.e. hanging mode.

In order to suppress or eliminate insignificant levels or amplitudes of the impact r pulses 470, a threshold circuit (not shown) can be inserted between the impact pulse 470 and the input terminal of the DSP 414. The threshold circuit may operate in a similar manner to the threshold circuits of the previous embodiments. Alternatively, or in addition, to the threshold circuit, a low-pass filter with a certain cut-off frequency may be inserted in front-of the threshold circuit and make an initial suppression of unwanted high-frequency components or noise, i.e. components above the cut-off frequency, of the acceleration signal or pulse 470. The cut-off frequency of the lowpass filter may be larger than 100 Hz, or 1 kHz, however, other cut-off frequencies depending on a specific need may be envisioned.

Figure 5:
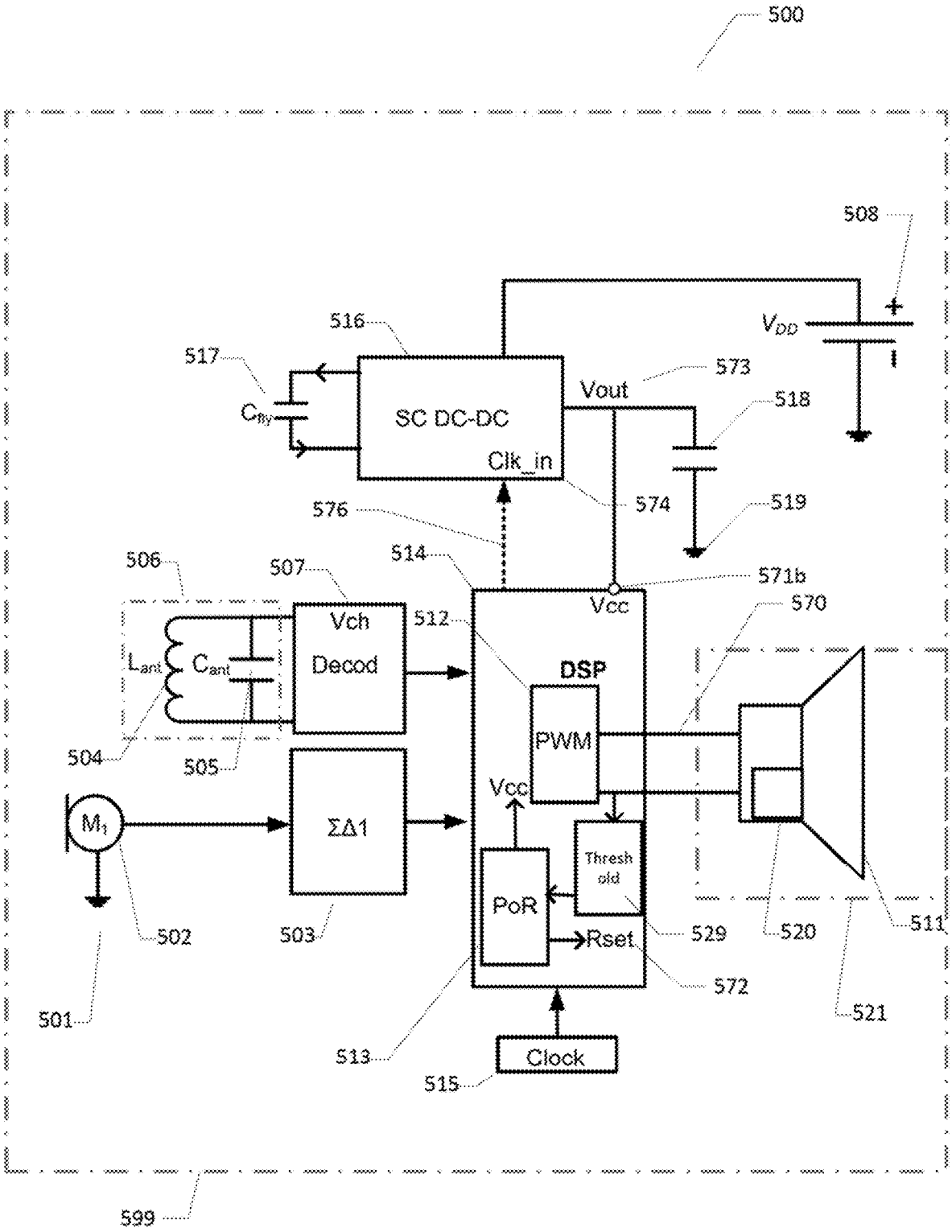
FIG. 5 shows a simplified schematic block diagram of a head-wearable hearing device comprising a moving armature receiver used as impact sensor in accordance with a fifth embodiment.

FIG. 5 is a schematic representation or a block diagram of a fifth embodiment of the head-wearable hearing device 500, wherein the impact sensor 520 is an integral part of the miniature loudspeaker 511, or the miniature loudspeaker 521 itself operates as an impact sensor similar to the embodiments described in FIG. 3. In a manner similar to embodiments described in connection with FIGS. 2, 3 and 5, a switched-capacitor DC-DC power converter 516 may be utilized to power the DSP 514 through its supply voltage input 571*b*. The impact signal or pulse 570 is applied first to a threshold circuit 529 which is integrated on semiconductor circuit also holding the DSP 514. The threshold circuit 523 may operate in a substantially similar manner to the previously discussed threshold circuit 229 on FIG. 2. Hence, when the incoming impact signal or pulse 570 exceeds the predetermined threshold voltage, the output signal of the threshold circuit 523 switches logic state e.g. from logic high to logic low or vice versa. This change of logic state of the output of the threshold circuit 529 is applied to an input of a reset circuit 513 which in turn asserts or activates the reset signal 572, thus rebooting the DSP 514 as explained previously.

Thus, a simple and user-operable rebooting mechanism is provided to reboot the head-wearable hearing device 500 in case of dead-end failure mode or state of non-response. In some of the embodiments, the switched-capacitor DC-DC power converter 516 could be an optional component and the voltage supply 508 may be directly connected to the DSP 514 through a voltage input 571*b*.

Figure 6:
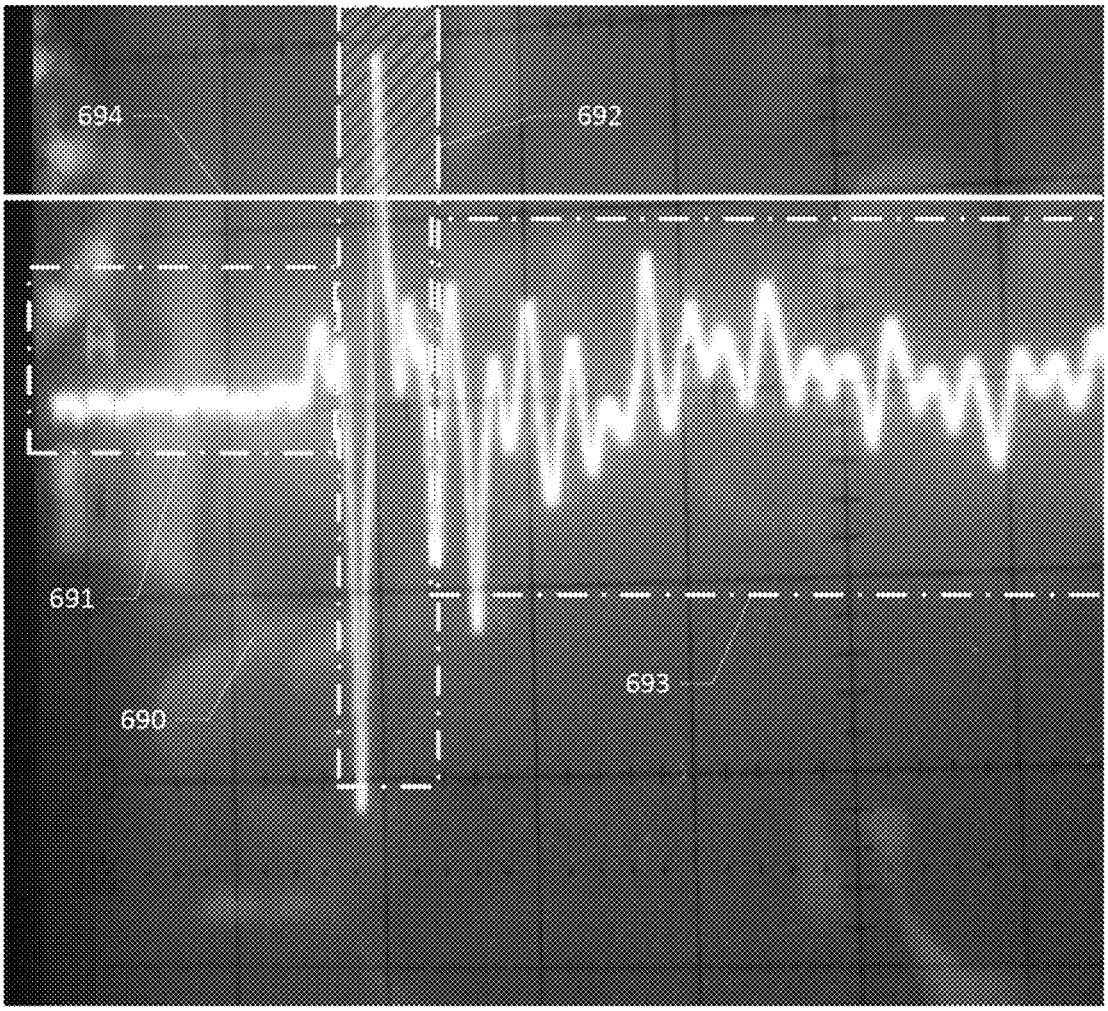
FIG. 6 shows an exemplary experimentally measured impact pulse generated by a moving armature type of hearing aid receiver.

FIG. 6 shows an exemplary experimentally measured impact pulse 690 generated by a moving armature type of hearing aid receiver or miniature loudspeaker operating in the previously discussed reverse mode where the moving armature receiver is abruptly accelerated, e.g. by an impact or mechanical shock. The impact pulse 690 is measured at the signal input terminals of the receiver that are connected to the class D output amplifier during operation of the hearing aid.

The depicted time scale is 0.2 ms per division and the voltage scale is 10 V per division. The impact pulse waveform exhibits several phases over the depicted time span, which is about 2 ms. An exemplary predetermined threshold voltage 694 of the previously discussed threshold circuits 229, 529 is projected onto the waveform plot to assist the explanation herein. The predetermined threshold voltage 694 is about 12.0 V. During a first phase 691 the receiver is subjected to a relatively small acceleration leading to minor impact signal fluctuations caused by noise or small movement that may correspond to walking or running. The impact signals or pulses falls well below the predetermined threshold voltage 694 and therefore to do not trigger any rebooting of the DSP. As mentioned previously, the predetermined threshold voltage may naturally be adapted according to the impact sensitivity of any specific impact sensor.

When the hearing aid receiver is impacted on a hard surface, one or several corresponding impact signals or pulses of large amplitude are generated in response as evident from the positive going and negative going impact waveform peaks during the second phase 692. In some of the embodiments, a protective diode may be utilized in order to protect the input of the threshold circuit, or the input of the controllable supply switch circuit, or in the output of the DSP, as the case may be, against the negative going impact pulse to prevent overvoltage damage to active or passive components (this also holds for the Class-D output terminals). As illustrated, the positive going impact waveform peak or impact pulse reaches about 19 V and therefore exceeds the predetermined threshold voltage 694 such that the reset circuit of the DSP is triggered. This triggering may be carried out either indirectly through the controllable supply switch circuit or directly by applying the impact pulse to the first input of the threshold circuit and coupling the output of the threshold circuit, which output switches logic state, to the input of the reset circuit on the DSP.

The positive going and negative going impact waveform peaks are typically followed by a gradual return to quiescent conditions of the impact waveform during the third phase 693 wherein acceleration of the device housing is decreasing after the impact. As schematically illustrated, the impact signal remains below the predetermined threshold voltage 694 during the third phase 693 and will therefore not trigger the reset circuit and cause unwanted reboot of the head-wearable hearing device.

In some of the embodiments, the device housing may have a user moveable, operable or actuable battery chamber which may be switched between an open state where the battery voltage is interrupted and a closed state where the battery voltage is applied to the battery voltage input of the device. However, the skilled person will also recognize that in preferred embodiments the housing may be without a user actuable battery chamber wherein the battery chamber may be configured for holding of a battery cell for supplying the battery voltage to the DSP. In such embodiments, the DSP cannot be reset by temporarily interrupting the battery voltage, and hence the power supply voltage of the DSP, e.g. by opening and closing the battery chamber. By omitting the user actuable battery chamber, for instance, improved mechanical robustness and waterproof properties of the housing structure may be achieved. The lack of a user actuable battery chamber may also simplify the design of the head-wearable hearing device by having fewer separate parts and thus reduce manufacturing costs.

The above-described user-operable rebooting mechanism is likewise advantageous in other embodiments of the head-wearable hearing device where the housing has neither an externally accessible battery chamber nor any user-actuable controls such as control switches, knobs, push-buttons etc. In relations to these embodiments, the head-wearable hearing device may be controlled through a remote user interface (not shown), for instance a wireless hand-held remote control or a computer-based software product installed on a portable terminal. In some of the embodiments, the wireless connection may be established through the previously discussed near-field magnetic inductive antenna and link to receive and/or transmit wireless digital data or signals to the external device such as a hand-held remote control.

Although particular features have been shown and described, it will be understood that they are not intended to limit the claimed invention, and it will be made obvious to those skilled in the art that various changes and modifications may be made without departing from the scope of the claimed invention. The specification and drawings are, accordingly to be regarded in an illustrative rather than restrictive sense. The claimed invention is intended to cover all alternatives, modifications and equivalents.

The invention claimed is:

1. A head-wearable hearing device comprising:

a housing;

a microphone arrangement configured to generate a microphone signal in response to incoming sound;

a digital signal processor configured to generate a processed output signal based on the microphone signal in accordance with one or more audio processing algorithms;

an impact sensor configured to generate an impact pulse or impact signal in response to mechanical impact of the housing;

a reset circuit configured to apply a reset signal to place the digital signal processor in a predetermined logic state; and a miniature loudspeaker or a receiver;

wherein at least a part of the impact sensor is implemented using a diaphragm of the miniature loudspeaker or the receiver; and wherein the reset circuit is configured to generate the reset signal based on a voltage pulse from the miniature loudspeaker or the receiver.

2. The head-wearable hearing device according to claim 1, further comprising a DC-DC power converter configured to generate a power supply voltage for the digital signal processor by conversion of a battery voltage.

3. The head-wearable hearing device according to claim 1, wherein the head-wearable hearing device has no user-actuatable control for resetting the head-wearable hearing device.

4. The head-wearable hearing device according to claim 1, wherein the miniature loudspeaker or the receiver is configured to generate a processed sound signal based on the processed output signal for transmission to an ear canal of a user.

5. The head-wearable hearing device according to claim 1, wherein the impact sensor comprises an electrodynamic motor drive of the miniature loudspeaker or the receiver.

6. The head-wearable hearing device according to claim 1, wherein the impact pulse or the impact signal is from an input terminal of the miniature loudspeaker or the receiver, or is derived from signal transmitted via the input terminal of the miniature loudspeaker or the receiver.

7. A head-wearable hearing device comprising:

a housing;

a microphone arrangement configured to generate a microphone signal in response to incoming sound;

a digital signal processor configured to generate a processed output signal based on the microphone signal in accordance with one or more audio processing algorithms;

an impact sensor configured to generate an impact pulse or impact signal in response to mechanical impact of the housing; and a reset circuit configured to apply a reset signal to place the digital signal processor in a predetermined logic state;

wherein the reset circuit is configured to generate the reset signal in response to the impact pulse or the impact signal generated by the impact sensor wherein the head-wearable hearing device further comprises a controllable supply switch circuit configured to temporarily disconnect or remove a power supply voltage for the digital signal processor in response to the impact pulse or the impact signal; and wherein the reset circuit is configured to monitor the power supply voltage for the digital signal processor, and to apply the reset signal in response to an interruption of the power supply voltage.

8. The head-wearable hearing device according to claim 7, further comprising a DC-DC power converter configured to generate the power supply voltage for the digital signal processor by conversion of a battery voltage.

9. The head-wearable hearing device according to claim 7, further comprising a battery voltage input for receipt of a battery voltage to provide the power supply voltage for the digital signal processor.

10. The head-wearable hearing device according to claim 7, further comprising a miniature loudspeaker or receiver configured to generate a processed sound signal based on the processed output signal for transmission to an ear canal of a user.

11. The head-wearable hearing device according to claim 7, wherein at least a part of the impact sensor is implemented using a miniature loudspeaker or a receiver, such that a diaphragm and an electrodynamic motor drive of the miniature loudspeaker or the receiver function as the at least a part of the impact sensor.

12. The head-wearable hearing device according to claim 7, wherein the impact pulse or the impact signal is from an input terminal of a miniature loudspeaker or a receiver, or is derived from signal transmitted via the input terminal of the miniature loudspeaker or the receiver.

13. The head-wearable hearing device according to claim 7, wherein the reset circuit comprises a reset input configured to receive the impact pulse or the impact signal.

14. The head-wearable hearing device according to claim 7, wherein the controllable supply switch circuit is electrically connected between at least one of:

a battery voltage input of the hearing device and a supply voltage input of a DC-DC power converter, and an output voltage of the DC-DC power converter and a supply voltage input of the digital signal processor.

15. The head-wearable hearing device according to claim 7, wherein the controllable supply switch circuit is configured to temporarily shut-down a DC-DC power converter.

16. The head-wearable hearing device according to claim 7, further comprising a threshold circuit configured to eliminate or suppress impact pulses or impact signals that are below a predetermined threshold level.

17. The head-wearable hearing device according to claim 16, wherein the predetermined threshold level is 1.0 V, 2.0 V or 5.0 V.

18. The head-wearable hearing device according to claim 16, wherein the threshold circuit comprises a comparator comprising:

a first input configured to receive the impact pulse or the impact signal;

a second input connected to a reference voltage generator setting the predetermined threshold level; and a comparator output connected to a control input of the controllable supply switch circuit.

19. The head-wearable hearing device according to claim 18, wherein a logic state of the comparator output is associated with a voltage difference or current difference between the first and second inputs of the comparator.

20. The head-wearable hearing device according to claim 16, comprising a low-pass filter configured to low-pass filter the impact pulses or the impact signals, wherein the low-pass filter has a cut-off frequency below 1 kHz.

21. The head-wearable hearing device according to claim 7, wherein the controllable supply switch circuit is operatively connected between a battery voltage input of the hearing device and a DC reference potential, to temporarily short-circuit the battery voltage input.

22. The head-wearable hearing device according to claim 7, wherein the controllable supply switch circuit comprises at least one controllable switch, the at least one controllable switch comprising:

a switch input node, a switch output node, and control terminal, wherein the control terminal is configured to switch the controllable supply switch circuit between: (1) a conducting state/on-state in which the switch input node and the switch output node are electrically connected, and (2) a non-conducting state/off-state in which the switch input node and the switch output node are electrically disconnected.

23. The head-wearable hearing device according to claim 7, further comprising one or more rechargeable battery cell(s) arranged inside the housing.

24. The head-wearable hearing device according to claim 23, wherein the housing is without a user-actuatable battery chamber holding the one or more rechargeable battery cell(s).

25. The head-wearable hearing device according to claim 7, wherein the head-wearable hearing device has no user-actuatable control for resetting the head-wearable hearing device.

26. A method of rebooting the digital signal processor of the head-wearable hearing device of claim 7, comprising:

removing the head-wearable hearing device from an ear; and striking the housing of the head-wearable hearing device to cause the impact sensor to generate the impact pulse or the impact signal.

* * * * *